United States Patent [19]

Bryan et al.

[11] Patent Number: 4,566,185

[45] Date of Patent: Jan. 28, 1986

[54] DEVICE AND METHOD FOR FIRMING-UP A PLUG-SOCKET CONNECTION

[76] Inventors: Horace Bryan, 12, Brighton La., Brooklyn, N.Y. 11235; 38

[21] Appl. No.: 616,715

[22] Filed: Jun. 4, 1984

[51] Int. Cl.[4] ..... H01R 13/639

[52] U.S. Cl. ..... 29/845; 339/75 P; 339/113 R

[58] Field of Search ..... 29/845; 339/75 P, 113 R

[56] References Cited

U.S. PATENT DOCUMENTS

| | | | |
|---|---|---|---|
| 2,559,151 | 7/1951 | Getzoff | 339/36 |
| 2,725,543 | 11/1955 | Tanner | 339/75 P |
| 2,728,058 | 12/1955 | Phalen | 339/75 P |
| 3,163,481 | 12/1964 | Salvador | 339/75 P |
| 3,475,716 | 10/1969 | Laig | 339/75 P |
| 4,097,105 | 6/1978 | Zumwalt | 339/75 P |
| 4,159,858 | 7/1979 | Toraya | 339/12 R |
| 4,302,624 | 11/1981 | Newman | 339/36 |
| 4,343,525 | 8/1982 | Knickerbocker | 339/75 P |
| 4,463,999 | 8/1984 | Knickerbocker | 339/75 P |

FOREIGN PATENT DOCUMENTS

| | | | |
|---|---|---|---|
| 2045546 | 10/1980 | United Kingdom | 339/113 R |

*Primary Examiner*—John McQuade

*Attorney, Agent, or Firm*—Erwin S. Teltscher

[57] ABSTRACT

A flexible plug-to-socket connection firming-up device which is at least partly foldable from an initially substantially flat and inoperative state to at least a partly folded operative state includes an adhesive strip adapted for being connected to at least a holder of the socket, and flaps connected to the adhesive strip, and adapted to be at least partially wrapped around the plug so as to restrain the plug from being unintentionally unplugged from the socket.

7 Claims, 4 Drawing Figures

DEVICE AND METHOD FOR FIRMING-UP A PLUG-SOCKET CONNECTION

BACKGROUND OF THE INVENTION

Standard electrical plugs are provided with prongs normally inserted into corresponding resilient, for example, spring-loaded prong-holders embedded within a socket, and which are to be mated with the plug. These initially resilient or spring-loaded prong-holders, however, lose some of their resiliency in time, and consequently their ability to firmly hold the prongs of the plug decreases with the passage of time also. This, in turn, leads often to intermittent operation of the devices connected through the plug to the corresponding socket, or, alternatively, the plug may be accidentally and unintentionally removed from the socket. This results at best in an inconvenience to the user, but may even have worse consequences, when, for example, children attemp to play with the plug and socket, disconnect the plug during such play, and may even come in contact with the live and electrically active portions of the prong holder or prong holders in the socket.

Ways and means have already been sought to make such a plug and socket connection at least reasonably safe for children. Thus Newman, in U.S. Pat. No. 4,302,624 teaches an electric outlet wall protector, while Toraya in U.S. Pat. No. 4,159,858 teaches a cover plate for a socket, and Getzoff in U.S. Pat. No. 2,559,151 teaches a safety guard for electric outlets.

All of the above-noted prior art devices solve, however, only part of the problem, namely they make the outlet at least safe for children, for example. No means are provided in these known devices to guard against any deterioration in the resilient properties of the prong-holder in existing wall sockets, or other sockets already available on the market, namely to provide a a more secure connection between a plug and a socket, which reduces the likelihood of the connection being subject to frequent malfunction. Furthermore the devices of the prior art are bulky and unwieldy, and not capable of being easily retrofitted.

SUMMARY OF THE INVENTION

It is therefore a principal object of the present invention to obviate the disadvantages of the prior art, and to devise a plug-to-socket firming-up device which ensures a better permanency in the connection between a selected plug and a selected socket, while permitting an easy removal of the already plugged-in plug from the socket.

It is another object of the present invention to make such a plug-to-socket firming-up device as inexpensive as possible, and easy to ship, so that a plurality of such devices can be easily packaged, while each is in an inoperative flat state.

It is yet another object of this invention to reduce the safety hazard to children, who may attempt to place metallic objects into the socket as a replacement for the plug, which may accidentally or otherwise have become detached from the socket.

It is still another object of the present invention to to permit positive identification of each plug-to-socket connection selected, such as, for example, by inscribing alpha-numeric letters thereon, which advise a user which device, such as a lamp, a television set, a computer, etc. is connected to the selected socket.

These, and other objects of the invention are attained by a flexible plug-to-socket connection firming-up device which is at least partly foldable from an initially substantially flat and inoperative state to at least a partly folded operative state, and which includes an adhesive strip adapted for being connected to at least a holder of the socket, and flags connected to the adhesive strip, and adapted to be at least partially wrapped around the plug, so as to restrain the plug from being unintentionally unplugged from the socket.

In a preferred embodiment there is provided a second adhesive strip, which is connected to the first adhesive strip, and the side of the second adhesive strip, which operatively faces away from the socket, is adapted to be inscribed with alpha-numeric characters.

Other objects of the invention will become apparent hereafter, and or be set forth in the description, or in the dependent claims.

BRIEF DESCRIPTION OF THE DRAWINGS

The invention will be better understood with the aid of the drawings, in which.

DESCRIPTION OF THE PREFERRED EMBODIMENTS

Figure 1:
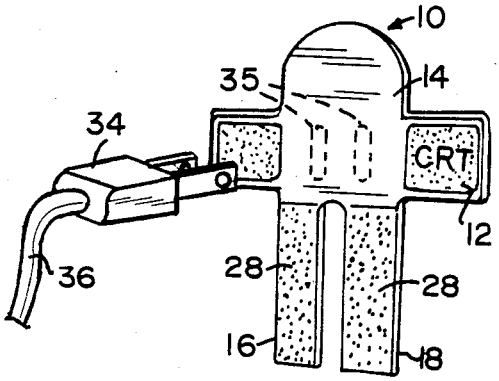
FIG. 1 is a perspective view of the rear side of the inventive plug-to-socket firming-up device in its initial flat, or inoperative state, prior to a plug being passed therethrough.
Figure 3:
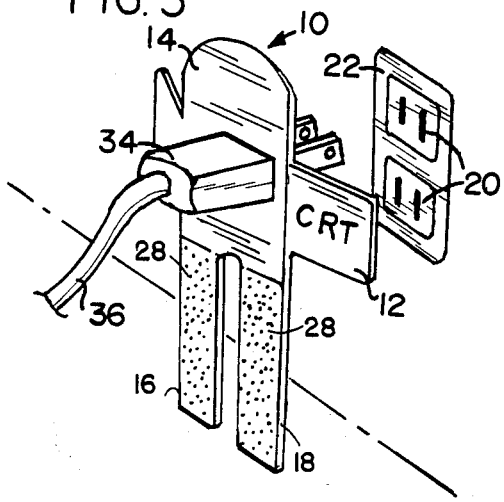
FIG. 3 is a perspective view which corresponds to that of FIG. 3, but showing the other side of the device, with the backing material being in the process of being peeled off from the adhesive strip of the device.
Figure 2:
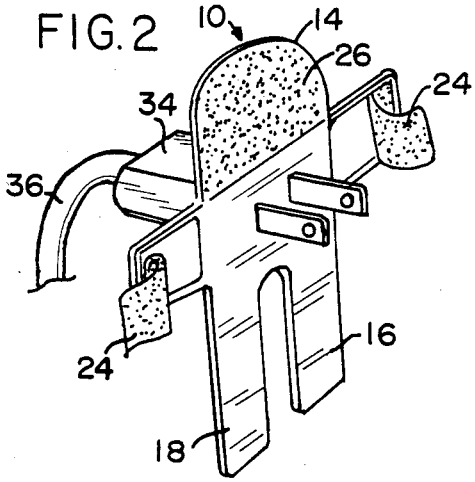
FIG. 2 is a perspective view corresponding to FIG. 1, but with the plug already passed through the device, and wherein the plug-to-socket firming-up device is still in its flat and inoperative state.

Referring now to the drawing, an initially substantially flat plug-to-socket connection firming-up device 10 is formed from a carrier and adhesive means, such as a longitudinal adhesive strip 12, and from connecting means, such as wrap-around means, for example in the form of a first flap 14, and a second flap subdivided into flap portions 16 and 18, which are connected to the adhesive strip 12. Both flaps are preferably integral with the adhesive strip. The adhesive strip 12 carries the adhesive material on a side thereof operatively facing a socket or sockets 20, which are mounted in a socket holder 22. Backing material in the form of a backing strip 24 is applied to the adhesive material, but is peeled off therefrom, as shown in FIG. 2, before the adhesive strip 12 is adhered to the socket holder 22, and preferably also the socket 20.

The flap 14 is provided on a side thereof operatively facing the socket 20 and the socket holder 22 with adhesion enhancing means, as, for example, with a Velcro® patch 26, while the flap portions 16 and 18 are provided on sides thereof operatively facing away from the socket 20 or socket holder 22 with adhesion enhancing means, such as Velcro® strips 28. In a preferred embodiment of the invention the adhesive strip 12 carries on a side thereof facing away from the socket 20 and the socket holder 22 connection-identifying means, such as a second adhesive strip 30, the outer surface of which is adapted to be inscribed with alpha-numeric characters, such as lettering 32.

Figure 4:
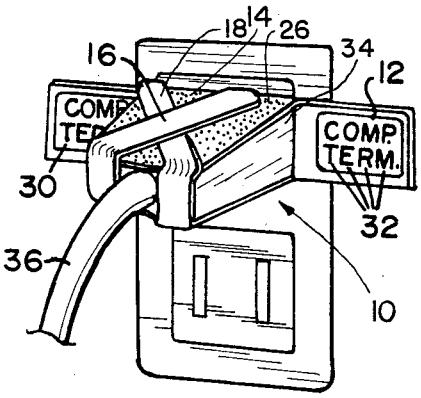
FIG. 4 is a perspective view of the device in its final, or operative state.

The firming-up of a connection between a plug 34 and a socket 22 is carried out, for example, in the following steps:

The plug 34 is passed in an initial step through the adhesive strips 12 and 30, which may be formed in one version of the inventive device with respective longitudinal slits 35, or the plug 34 may be arranged to pierce the adhesive strips so as to form the slits 35 in passing therethrough. Prior to adhering the device to the socket 20, the backing material 24 is peeled off from the adhesive strip 12, and the plug 34 is inserted into the socket 20, and the adhesive strip 12, freed of its backing material, is made to adhere to the socket holder 22, and preferably also to the socket 20. Thereafter the adhesion enhacing or facilitating means, such as the Velcro® patch 26 of the flap 14 are connected to the adhesion facilitating means of the flap portions 16 and 18. This may be accomplished, for example, by bending over the flap 14, as shown in FIG. 4, and thereafter laying the flap portion 16 thereon, so that one flap portion, for example the flap portion 18, comes to lie over the other flap portion, namely the flap portion 16. This results in the flap portions 16 and 18 being at least partially wrapped around the plug, while substantially clearing a wire 36 attached to the plug 34. The plug 34 is consequently restrained from being unintentionally unplugged from the socket 22.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. A flexible plug-to-socket connection firming-up device partly foldable from an initially substantially flat and inoperative state to at least a partly folded operative state, comprising in combination attachment means including a carrier and adhesive means affixed to said carrier, said adhesive means being adapted to adhere at least to a socket holder, said carrier and said adhesive means including an adhesive strip extending along a longitudinal direction, and further including a backing material normally adhering to an external side of said adhesive strip, but being capable of readily being peeled off therefrom prior to the attachment of said carrier to said socket holder, and connecting means having two major sides, and being connected to said attachment means, and including wrap-around means adapted to at least partially surround the plug, while substantially clearing a wire connected to said plug, said wrap-around means including first and second flaps extending normally outwardly from said longitudinal strip on respective opposite elongated sides thereof, and being releasably securable to one another at least near respective ends thereof, each flap including adhesion-enhancing means for facilitating adhesion of one flap to the other flap, while being substantially free from any adhesion-facilitating means enabling adhesion of one of said flaps to said attachment means, said adhesion enhancing means being applied to said first flap on a side thereof coinciding with one of said major sides, and being applied to said second flap on a side thereof coinciding with the other of said major sides, at least one of said flaps being formed with a V-shaped or U-shaped recess so as to subdivide said one of said flaps into two elongated flap portions normally extending transversely to said longitudinal direction, whereby, upon passing the plug from a side of the firming-up device opposite to said backing material through said elongated adhesive strip, thereafter peeling off said backing material from said elongated adhesive strip, thereafter plugging the plug into the socket, thereafter attaching the elongated adhesive strip at least to a holder of the socket, thereafter crossing said flap portions over one another, so that one flap portion lies over the other flap portion, and connecting the adhesion enhancing means of the flap portions and of the remaining flap to one another, so as to wrap said flap portions at least partially around the plug, while substantially clearing said wire attached to the plug, the plug is restrained from being unintentionally unplugged from said socket.

2. The plug-to-socket connection firming-up device as claimed in claim 1, wherein said adhesion enhancing means includes Velcro®.

3. The plug-to-socket connection firming-up device as claimed in claim 1, further comprising connection-identifying means attached to said connecting means on a side thereof normally facing away from the socket.

4. The plug-to-socket connection firming-up device as claimed in claim 3, wherein said connection-identifying means includes a second adhesive strip adapted to be inscribed with alpha-numeric characters.

5. The plug-to-socket connection device as claimed in claim 1, wherein said connection means are integral with said attachment means, and include a fabric.

6. In a method of firming up a connection between a socket and a plug with the aid of a flexible and at least partly foldable plug-to-socket connection firming-up device, which includes an elongated adhesive strip extending along a longitudinal direction, backing material normally adhering to the elongated adhesive strip, but being peelable off therefrom, a flap normally extending outwardly from one elongated side of said elongated adhesive strip, two longitudinal flap portions normally extending outwardly from the other elongated side of said elongated adhesive strip, said flap and each flap portion including adhesion facilitating means enabling adhesion of the flap to any of said flap portions, said adhesion facilitating means being applied to said flap on a side thereof normally facing the socket, and being applied to each flap portion on a side normally opposite to said side, the steps comprising passing the plug from a side of the firming-up device opposite to said backing material through said elongated adhesive strip, peeling off said backing material from said elongated adhesive strip, plugging the plug into the socket, attaching the elongated adhesive strip at least to a holder of the socket, crossing said flap portions over one another, so that one flap portion lies over the other flap portion, and connecting the adhesion facilitating means of the flap to the adhesion facilitating means of the flap portions so as to wrap said flap portions at least partially around the plug, while substantially clearing any wire attached to the plug, whereby the plug is restrained from being unintentionally unplugged from said socket.

7. The method as claimed in claim 6, wherein a connection-identifying strip is attached to the adhesive strip on a side thereof normally facing away from the socket, and further comprising the steps of inscribing the connection-identifying strip with alpha-numeric characters.

* * * * *